United States Patent [19]

Hadaway

[11] Patent Number: 4,519,226

[45] Date of Patent: May 28, 1985

[54] PADLOCK

[76] Inventor: Robert J. Hadaway, 46 Buxton Rd., Wembley Downs, Australia, 6019

[21] Appl. No.: 407,952

[22] Filed: Aug. 13, 1982

[30] Foreign Application Priority Data

Oct. 30, 1981 [AU] Australia ..... 76967/81

[51] Int. Cl.[3] ..... E05B 67/28

[52] U.S. Cl. ..... 70/48

[58] Field of Search ..... 70/31–34, 70/27, 48

[56] References Cited

U.S. PATENT DOCUMENTS

| | | | |
|---|---|---|---|
| 1,372,020 | 3/1921 | Grimes | 70/33 |
| 2,104,981 | 1/1938 | Falk | 70/33 |
| 2,140,490 | 12/1938 | Wise | 70/33 |

FOREIGN PATENT DOCUMENTS

| | | | |
|---|---|---|---|
| 3589 | 3/1901 | Austria | 70/31 |
| 411689 | 5/1945 | Italy | 70/33 |
| 414681 | 8/1946 | Italy | 70/33 |
| 3887 | of 1868 | United Kingdom | 70/48 |
| 19329 | 7/1904 | United Kingdom | 70/48 |
| 240334 | 10/1925 | United Kingdom . | |
| 238576 | 5/1926 | United Kingdom . | |
| 272387 | 6/1927 | United Kingdom . | |
| 448981 | 6/1936 | United Kingdom . | |

*Primary Examiner*—Robert L. Wolfe
*Assistant Examiner*—Lloyd A. Gall
*Attorney, Agent, or Firm*—Dennison, Meserole, Pollack & Scheiner

[57] ABSTRACT

The present invention provides a padlock comprising a padlock body having formed therein a slot arranged to receive an object to be secured, a hasp mounted in the body and arranged to be moved between a first, inoperative position in which the slot can receive an object to be secured and a second, operative position in which it is disposed across the slot, said hasp being retained in said body in all phases of its operation and, when in the operative position, extending across the slot within the confines of the body so that the portion of the hasp securing the object is shrouded.

The padlock of the present invention comprises a hasp which, when in the locked position, is shrouded but which does not have to be removed completely from the padlock body when not in use.

5 Claims, 4 Drawing Figures

PADLOCK

The present invention relates to a padlock. Presently available padlocks typically comprise a hasp which, when in the locked position, is exposed. The hasp is looped through an object to be secured but because of the exposed nature of the hasp, both the hasp and the secured object are vulnerable to abuse.

Alternative padlocks have a shrouded hasp which is required to be removed completely from the padlock body when not in use. This leads to the possibility of the hasp being lost. The present invention provides a padlock wherein the hasp is retained with the padlock body in all phases of its operation and which is not exposed when in the locked position. In accordance with the present invention there is provided a padlock comprising a padlock body having formed therein a slot arranged to receive an object to be secured, a hasp mounted in the body and arranged to be moved between a first, inoperative position in which the slot can receive an object to be secured and a second, operative position in which it is disposed across the slot, said hasp being retained in said body in all phases of its operation and, when in the operative position, extending across the slot within the confines of the body so that the portion of the hasp securing the object is shrouded.

As will be described hereinafter in detail, the padlock of the present invention may comprise a hasp arranged to be actuated by a rack and pinion mechanism.

The hasp itself can take a variety of forms. For example, it could be arranged for rotary movement or it could be arranged for linear movement.

The present invention will now be described, by way of example, with reference to the accompanying drawings, in which.

Figure 1:
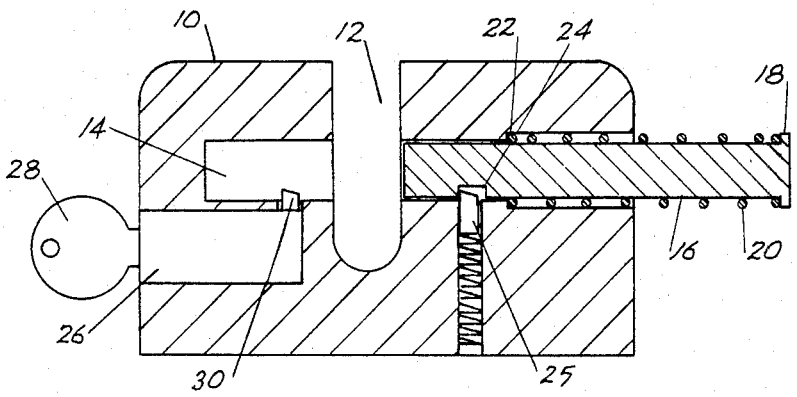
FIG. 1 is a vertical sectional view of a padlock in accordance with one embodiment of the present invention in unlocked condition.
Figure 2:
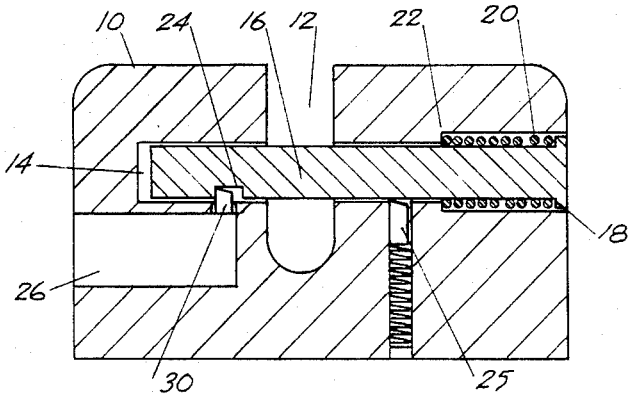
FIG. 2 is a vertical sectional view of the padlock of FIG. 1 in locked condition.

In FIGS. 1 and 2, there is shown a padlock comprising a padlock body 10 having formed therein a slot 12. The slot 12 is wide enough and deep enough to accept a pad-bolt tongue or a chain link or the like.

The body 10 also contains a blind tunnel 14 having an enlarged outer end for reasons which will be described hereinafter. The tunnel 14 extends from an outer margin of the body 10 across and beyond the slot 12. Mounted within the tunnel 14 for linear movement is a bolt 16. The bolt 16 has a flange 18 at its outer end. A coil spring 20 is mounted about the bolt 16 between the flange 18 and a shoulder 22 formed at the commencement of the enlarged outer end of the tunnel 14.

As can be seen in FIG. 1, the spring 20 normally urges the bolt 16 outwardly so as to be clear of the slot 12. Further, the bolt 16 adjacent its inner end contains a notch 24. The body 10 contains a spring biased pawl 25 which, in the inoperative position of the padlock shown in FIG. 1, is urged into engagement with the notch 24. The body 10 also contains a tumbler barrel lock 26 arranged to be unlocked by a key 28. The lock 26 comprises a latch 30 which is normally urged into the tunnel 14 in known manner and is arranged to engage with the notch 24. As shown, both the pawl 25 and the latch 30 have appropriately shaped inner surfaces to enable them to be depressed when the bolt 16 is pressed inwardly.

In use, the bolt 16 is normally urged outwardly by the spring 20 so as to be clear of the slot 12. This unlocked condition is shown in FIG. 1. When it is desired to secure an object the said object is placed in the slot 12 deeper than the tunnel 14. Then the bolt 16 is pressed inwardly against the action of the spring 20 so as to pass through the slot 12 and an appropriate aperture in the object to be secured. This action depresses the pawl 25 as shown in FIG. 2. Subsequently the inner end of the bolt 16 depresses the latch 30 until the latch 30 becomes aligned with the notch 24. At this point the latch 30 is freed from constraint and enters the notch 24. This condition is shown in FIG. 2 and in this condition the padlock is locked until released by the key 28.

When it is released, the bolt 16 is automatically urged back to the position shown in FIG. 1 by the action of the spring 20 and thus the secured object is released. Further, as the bolt 16 is urged outwardly and the notch 24 becomes aligned with the pawl 25, the latter is urged outwardly into engagement with the notch 24 so as to arrest the outward movement of the bolt 16. As can be seen in FIG. 2, the bolt 16 serves as the hasp of the padlock and is entirely within the confines of the body 10 in the locked position. Thus, it is very difficult to interfere with the padlock when locked.

Figure 3:
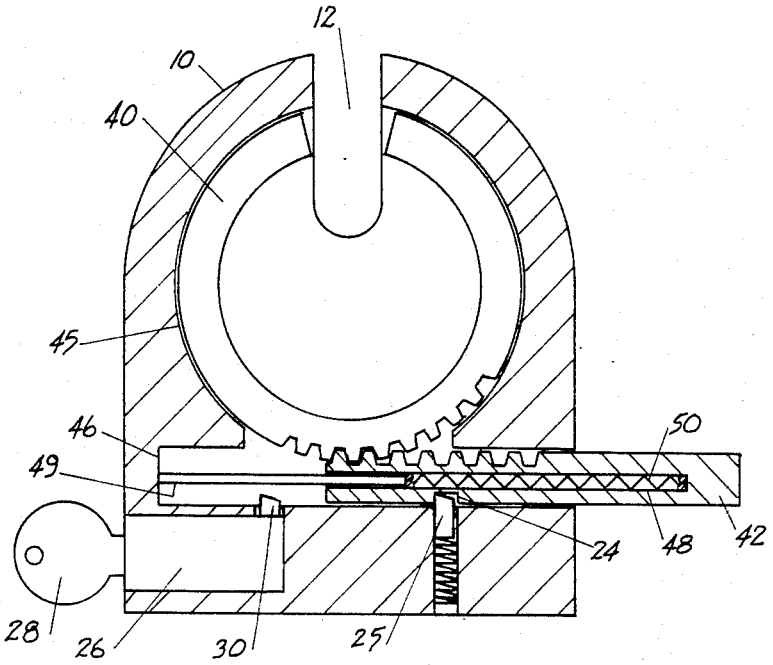
FIG. 3 is a vertical sectional view of a padlock in accordance with another embodiment of the present invention in unlocked condition.
Figure 4:
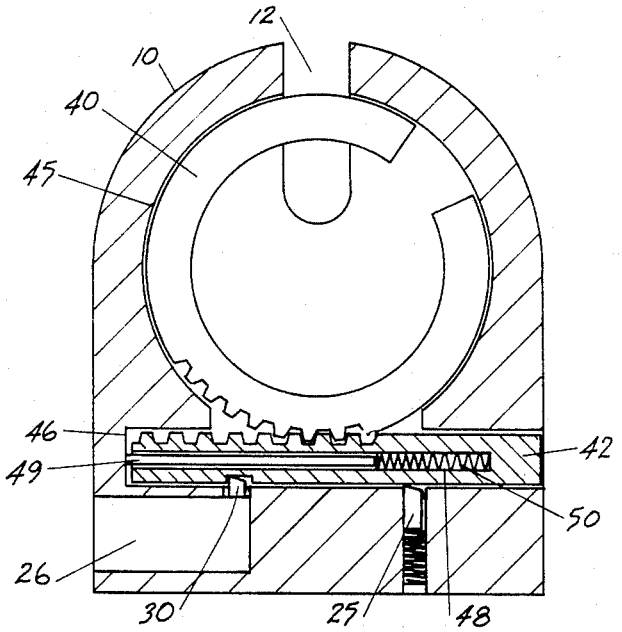
FIG. 4 is a vertical sectional view of the padlock of FIG. 3 in locked condition.

In FIGS. 3 and 4, there is shown a padlock in accordance with another embodiment of the present invention which operates on a similar principal to the padlock of FIGS. 1 and 2. Like reference numerals denote like parts. The main difference is that the hasp is actuated by a rack and pinion arrangement and is arranged for rotary motion. The hasp is in the form of a circular pinion 40 which is toothed over part of its external circumference. The toothed portion of the pinion 40 meshes with a toothed rack 42.

Further, the pinion 40 has a gap adjacent the slot 12, which gap, as noted in FIG. 3, is of substantially the same width as the slot 12.

The pinion 40 is partially rotatably mounted within a circular groove 45 in the body 10 and the rack 42 is mounted in a blind tunnel 46 for linear movement. At its lower end as seen in the drawings, the circular groove 45 merges with the tunnel 46. In this region, the rack 42 meshes with the pinion 40. The rack 42 is hollow and contains a blind recess 48 extending from one end of the rack 42. A pin 49 extends longitudinally of the tunnel 46 from the inner end thereof and into the recess 48. The hollow rack 42 also contains a compression spring 50 between the end of the pin 49 and the inner end of the recess 48.

In use, the rack 42 is normally urged outwardly of the body 10 by the action of the spring 50 as shown in FIG. 3. In this position the gap is aligned with the slot 12. An object to be secured can be inserted in the slot 12 and then the rack 42 depressed as with the bolt 16 of the embodiment of FIGS. 1 and 2.

Depression of the rack 42 rotates the pinion 40 to the position shown in FIG. 4 wherein it is looped through the object to be secured and then the rack 42 is locked by the notch 24 engaging with the latch 30 as with the embodiment of FIGS. 1 and 2.

The padlock of FIGS. 3 and 4 is unlocked by a key 28 as with the embodiment of FIGS. 1 and 2. This returns the pinion 40 and rack 42 to the position shown in FIG.

3, in which the pawl 25 is in engagement with the notch 24. The compression spring 50 can be located within, about or alongside the rack 42. Similarly, the spring 20, of FIGS. 1 and 2, can be located within, about or alongside the bolt 16. Also, the spring could be in the form of a coiled clock spring or the like within the pinion 40 and acting on the pinion 40 rather than the rack 42. Also, a hook or loop could be attached to the body 10 to enable the padlock to be conveniently retained at its required location. Further, the bolt 16 and the pinion 40 could both be actuated by a small pinion arranged to be turned by a key and arranged to act directly on the bolt 16 or pinion 40. Other modifications and variations such as would be apparent to a skilled addressee are deemed within the scope of the present invention. For example, instead of the spring biased pawl 25 there could be provided a resilient metal strip which is anchored at one end adjacent a shallow recess. At its other end the strip would be provided with a pawl similar in configuration to the pawl 25 and which would serve the same function. The pawl of this modification would simply be depressed into the shallow recess when not aligned with the notch 24.

I claim:

1. A padlock comprising a padlock body having formed therein a slot arranged to receive an object to be secured, a hasp mounted in the body for movement between a first, inoperative position in which the slot can receive an object to be secured and a second, operative position in which it is disposed across the slot for securing a received object therein, said hasp being retained in said body in all phases of its operation and, when in the operative position, extending across the slot within the confines of the body whereby the portion of the hasp securing the object is shrouded, said hasp comprising a pinion having a toothed portion, said pinion being mounted for partial rotation within the body and being formed with a gap which, in the first inoperative position of the hasp, corresponds with the slot in the body, a toothed rack mounted for free linear movement in said body, the toothed portion of said pinion meshing with said rack whereby, upon linear movement of said rack, partial rotation of the pinion is effected to move the hasp reversibly between its first and second positions, said rack having a first position, corresponding to the first position of the hasp, spring means resiliently urging said rack outwardly of the body and to its first position, said rack having a second position, corresponding to the second position of the hasp, said rack being manually accessible exteriorly of said body for manual depression of the rack toward said body and into its second position against the action of the spring means, and locking means for locking the hasp in its second, operative position.

2. A padlock according to claim 1, including key means for disengaging said locking means and releasing said hasp, said spring means, upon release of said hasp, automatically returning said rack and hasp to the respective first positions thereof.

3. A padlock according to claim 1, wherein said locking means acts on the rack to retain the rack in its second position against urging of said spring means and, therethrough, lock the hasp in its second, operative position.

4. A padlock according to claim 3 wherein said locking means comprising cooperating means on said rack and body for automatically engaging upon manual depression of said rack toward said second position to releasably preclude movement of said rack from said second position.

5. A padlock according to claim 4 wherein said pinion is circular with the gap defined generally radially therethrough.

* * * * *